United States Patent [19]

Tighe et al.

[11] Patent Number: 4,959,516

[45] **Date of Patent: * Sep. 25, 1990**

[54] SUSCEPTOR COATING FOR LOCALIZED MICROWAVE RADIATION HEATING

[75] Inventors: Laurence E. Tighe, Milford; Tim Parker, Shrewsbury, both of Mass.

[73] Assignee: Dennison Manufacturing Company, Framingham, Mass.

[ * ] Notice: The portion of the term of this patent subsequent to Oct. 24, 2006 has been disclaimed.

[21] Appl. No.: 348,012

[22] Filed: May 9, 1989

Related U.S. Application Data

[63] Continuation-in-part of Ser. No. 304,734, Jan. 31, 1989, Pat. No. 4,876,423, which is a continuation-in-part of Ser. No. 194,260, May 16, 1988, Pat. No. 4,864,089.

[51] Int. Cl.[5] ..... H05B 6/80

[52] U.S. Cl. ..... 219/10.55 F; 219/10.55 E; 99/DIG. 14; 426/107; 426/243

[58] Field of Search ..... 219/10.55 E, 10.55 F, 219/10.55 R, 10.55 M; 426/107, 234, 241, 243, 127; 427/383.1, 126.1; 99/DIG. 14, 451; 126/390; 428/35.7, 35.8, 34.2, 34.3, 34.7

[56] References Cited

U.S. PATENT DOCUMENTS

| | | | |
|---|---|---|---|
| 4,190,757 | 2/1980 | Turpin et al. | 219/10.55 E |
| 4,267,420 | 5/1981 | Brastad | 219/10.55 F |
| 4,518,651 | 5/1985 | Wolfe, Jr. | 219/10.55 E |
| 4,612,431 | 9/1986 | Brown | 219/10.55 E |
| 4,623,565 | 11/1986 | Huybrechts et al. | 219/10.55 E X |
| 4,640,838 | 2/1987 | Isakson | 219/10.55 E |
| 4,656,325 | 4/1987 | Keefer | 219/10.55 E |
| 4,661,671 | 4/1987 | Maroszer | 219/10.55 E |
| 4,751,358 | 6/1988 | Durand | 426/243 |
| 4,864,089 | 9/1989 | Tighe et al. | 219/10.55 E |
| 4,876,423 | 10/1989 | Tighe et al. | 219/10.55 E |

FOREIGN PATENT DOCUMENTS

| | | |
|---|---|---|
| 0242952 | 10/1987 | European Pat. Off. . |
| 0276654 | 8/1988 | European Pat. Off. . |
| 2186478 | 8/1987 | United Kingdom . |

*Primary Examiner*—Philip H. Leung

*Attorney, Agent, or Firm*—Barry D. Josephs; Arthur B. Moore

[57] ABSTRACT

A medium formed by a mixture of polymeric binder with conductive metal and either semiconductive particles or galvanic couple alloy particles that can be coated or printed on a substrate to convert electromagnetic radiation to heat without arcing and produce increase heating of foods. Conversion efficiency can be controlled by the choice, thickness, pattern and amount of materials used in the medium. The medium can be formulated to be used repeatedly without burn out or can be formulated to be used only once after which it becomes microwave inert. The conductive particles are typically aluminum, copper, zinc and nickel; the semiconductive particles are typically carbon, titanium carbide, silicon carbide and zinc oxide; and the galvanic couple alloy particles are typically aluminum-nickel alloy, aluminum-cobalt alloy and aluminum-copper alloy.

23 Claims, 2 Drawing Sheets

FIG. 1
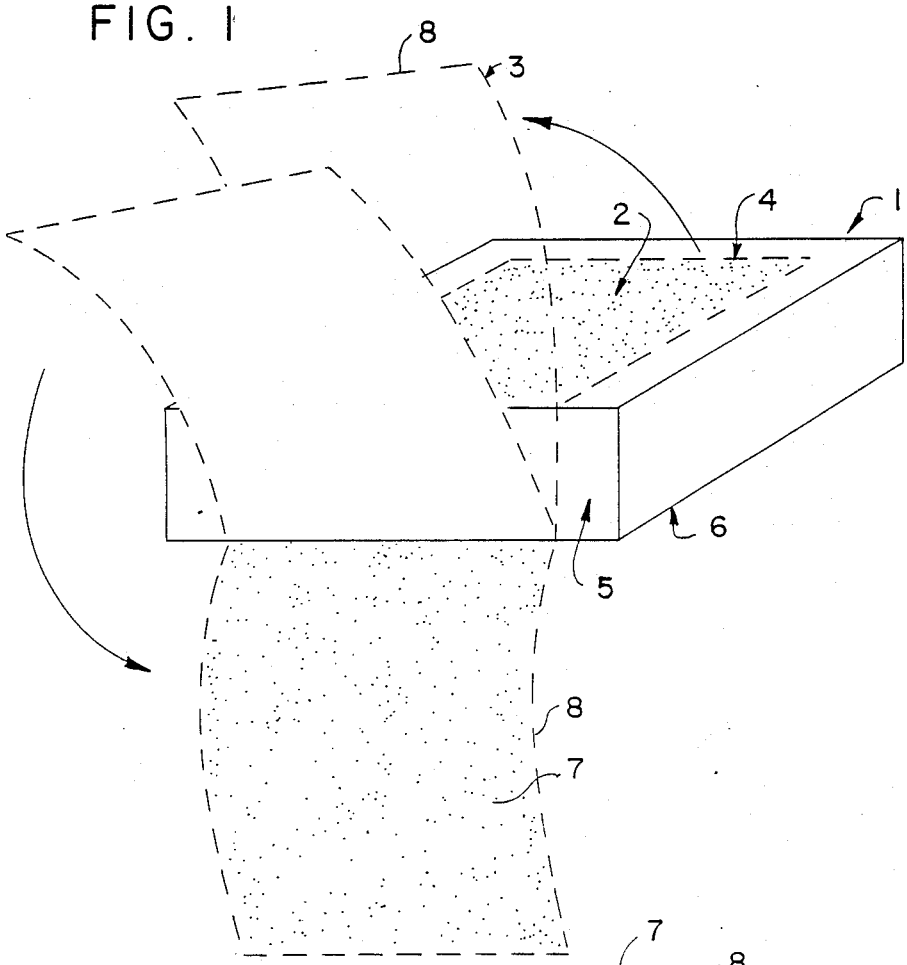
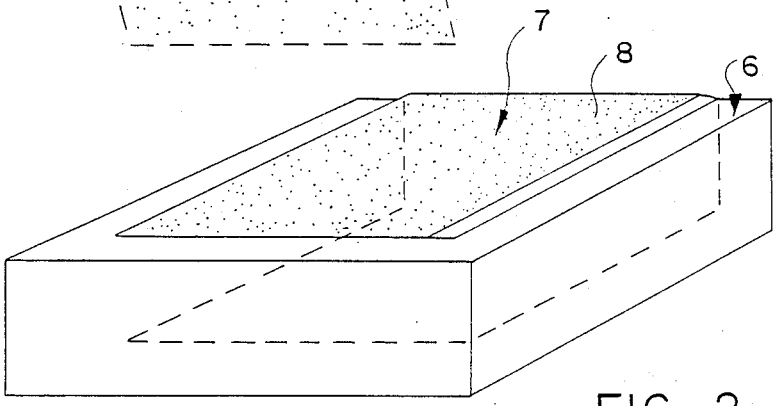
FIG. 2

SUSCEPTOR COATING FOR LOCALIZED MICROWAVE RADIATION HEATING

This application is a continuation-in-part of patent application Ser. No. 304,734 filed Jan. 31, 1989, now U.S. Pat. No. 4,876,423 which was a continuation-in-part of Ser. No. 194,260 filed May 16, 1988, now U.S. Pat. No. 4,864,089.

BACKGROUND OF THE INVENTION

1. Field of the Invention.

This invention relates to localized radiation heating and more particularly to localized heating in microwave appliances.

2. Description of the Prior Art.

In microwave heating, it can be desirable to provide localized surface heating to achieve such effects as browning and crisping. While the typical microwave oven is a suitable energy source for uniform cooking, it is not satisfactory for selective heating effects, such as browning and crisping. In fact, the typical microwave arrangement produces the cooking in which the external surface of the cooked material, particularly if desired to be crispy, tends to be soggy and unappetizing in appearance.

One attempt to provide suitable browning and crisping of microwave cooked foods has been by the selective use of virtually transparent, very thin metallized aluminum deposition on a carrier. Such material can produce heat and provide the desired crisping. The difficulty with this thinness of metal is that it can produce arcing and fuses out prematurely, thereby defeating the microwave operation. Arcing is manifested by visible electric sparks which appear on the metal surface.

A prior art susceptor of the type employing a surface coating of vacuum metallized aluminum is illustrated by the laminate of FIG. 4. In this laminate (24), a ½ mil (0.013 mm) layer or film of polyethylene terephthalate is used as a carrier (20). Upon this is deposited a 15–20 angstroms thickness of vacuum-metallized aluminum (21) that provides a surface resistivity varying between 20 and 50 ohms per square. Overlying the aluminum layer is an adhesive (22) such as ethylene vinyl acetate and an overlying cellulosic layer (23). When exposed to microwave radiation this susceptor heats up but soon shuts off like a fuse and therefore cannot be reused. During the heating cycle this susceptor has been known to produce arcing.

Another attempt to provide browning and crisping in a microwave oven has been by the use of metal filled polymeric coatings, especially aluminum flake filled coatings as in prior art such as European patent application No. 87301481.5 publication number 0 242 952, published Oct. 28, 1987. These coatings do provide heating upon microwave radiation exposure but the high degree of loading or coating thickness needed to achieve browning temperatures makes the coating prone to arcing.

In European patent application publication No. 0242952 published Oct. 28, 1987, a composite material for heat absorption of microwave energy is disclosed. The disclosed composite material is composed of a dielectric substrate such as polyethylene terephtalate film, coated with an electrically conductive metal or metal alloy in flake form, preferably aluminum flakes, in a thermoplastic dielectric matrix, e.g., a polyester copolymer.

Another attempt to provide the desired heating effect has been by the suggested use of carbon black coatings. These do not produce arcing but are generally found to be unsatisfactory because they produce uncontrolled, extreme run-away heating effect.

In U.S. Pat. No. 4,518,651 a susceptor material composed of carbon filled coating is disclosed. The susceptor material is composed essentially of carbon dispersed polymeric matrix. This reference does not employ metallic components in the susceptor coating. The disadvantage of the carbon based coating disclosed is that it tends to heat too rapidly and can cause ignition of the paperboard substrate cited, known in the art as thermal runaway. Thus, susceptor products of the type disclosed, while effective in terms of their heating properties, can cause hazards especially if the microwave oven is not very carefully monitored.

In U.S. Pat. No. 4,190,757, a susceptor composed of metallic oxide such as iron oxide or zinc oxide is disclosed. This reference also discloses that dielectric materials such as asbestos some fire brick, carbon and graphite can be employed in the susceptor energy absorbing layer. (Col. 7, lines 27 to 51). The reference does not disclose combinations of components other than combinations employing iron oxides for the energy absorbing layers or any advantages to be gained from combinations not utilizing the iron oxides. The reference is thus directed towards use of an iron oxide based coating for the energy absorbing layer. The iron oxide coating thickness is high, namely of the order of 1/16 to ⅛ inch (1.6 to 3.2 mm) which makes it impractical for use in conventional food packaging. Food packaging having such high coating thickness is costly to manufacture and would thus add considerably to the overall cost of the food product.

In U.K. patent publication GB No. 2186478A published Aug. 19, 1987, microwave energy absorbing decals for use on ceramic or glass-ceramic cookware untensils is disclosed. The decals are fused to the ceramic cookware. The decals have an energy absorbing layer which contain at least one metallic oxide and at least one metal in the unoxidized or reduced state. In preferred embodiments, the susceptor material can include iron oxides, nickel oxides and intermetallic oxides of iron and nickel such as nickel-iron ferrite and also can include nickel in the reduced state. The metallic oxides are selected from oxides of iron, nickel and zinc. The metal in the reduced state is selected from iron, nickel or zinc or their alloys. The decals are specifically intended for use on ceramic or glass-ceramic cookware and is not intended for use on paper or plastic packages due to the runaway heating produced.

This reference is not concerned with or directed towards use of an energy absorbing material for food packages, but rather the energy absorbing decals disclosed therein are designed for direct application to ceramic cookware.

Accordingly, it is an object of the invention to facilitate the selective heating of objects, particularly food. A related object is to improve the taste and texture of microwave heated foods. Another object is to maintain the wholesomeness and nutritional value of food.

A further object of the invention is to overcome the disadvantages experienced in the use of vapor deposited metallic coatings in attempting to supply a supplemental heating effect in microwave cooking.

Another object of the invention is to surmount the disadvantages experienced in the use of metal filled polymeric coatings in the attempt to furnish auxiliary heating in microwave cooking.

Still another object of the invention is to overcome the disadvantages that have been experienced in obtaining localized heating effects. A related object is to overcome the difficulties particularly unmanageable runaway heating that have prevented carbon black coatings from being used for localized heating.

SUMMARY OF THE INVENTION

In accomplishing the foregoing and related objects, the invention provides a medium for selected conversion of radiation to heat in which a fluid carrier is used to disperse a particulate filler composite of conductive and semiconductive substances or alloys of galvanic couples in polymer solution or dispersion. The conductive substances desirably are flakes, powder, needles, fiber and/or fluff, for example, of metals such as aluminum, nickel, zinc or copper; the semiconductive substances are particles, for example, of carbon, titanium carbide or zinc oxide; and the alloys of galvanic couples are particles, for example of aluminum-nickel, aluminum-cobalt or aluminum-copper.

The medium is used as a coating or to provide a print pattern of a radiation heating susceptor of conductive and semiconductive substances in a polymeric binder. It is theorized that the semiconductive substances provide a bridging/spacing effect with respect to the metallic substances so that the metallic substances are able to provide a desired controlled localized heating effect without arcing and without significally detracting from the heating effect. At the same time, the combination of the semiconductor materials with the metallic substances avoids the runaway heating effect that can occur with homogeneous materials such as carbon black particles. It has been found, for example, that when some inorganic fillers are added to an aluminum flake filled coating, the tendency to arc is greatly reduced or eliminated. However, some fillers such as MgO, $BaTiO_3$, $SrTiO_3$, $BaFe_{12}O_{19}$, $TiO_2$, $MgFe_2O_4$ and especially $SiO_2$ reduce the ability of the coating to heat in the presence of microwave radiation. Some inorganic materials such as $Fe_2O_3$, $Fe_3O_4$ and TiN do not inhibit arcing and may actually increase the tendency to arc but do not slow down the heating effect. There are some materials such as TiC, SiC, ZnO and carbon black which not only prevent arcing but do not adversely effect heating. Carbon black increases the heating effect.

Galvanic couple alloys can be used in place of semiconductive substances if a shut-off or fusing mechanism is preferred. A shut-off may be considered desireable for safety reasons concerned with thermal runaway. It is theorized that when galvanic couple alloy particles are added to conductive metal particles in the susceptor coating they form bridges between the conductive metal particles in much the same way that the semiconductive particles, described earlier, do. However, unlike the semiconductors, the galvanic couple alloys become oxidized or corroded by the induced current flowing through the susceptor upon exposure to microwaves. The rate of oxidation is also enhanced by the heat generated by the susceptor. It is theorized that some oxidation of the conductive metal particles may be initiated by the galvanic corrosion of the galvanic couple alloy particles. Such corrosion does not occur if the conductive metal is present by itself. After these bridges are oxidized the susceptor coating matrix is no longer conductive and therefore becomes microwave inert. This results in a shut off mechanism and the susceptor coating no longer heats up upon microwave exposure. It has been found that the oxidation of the metal can be further expedited by the inclusion of fusible salts such as potassium bisulfate. As the susceptor heats up the salt melts and becomes an oxidizing agent for the metallic particles.

The medium desirably includes a solvent to control viscosity, a fluid carrier which includes a polymeric binder in dispersion or solution by a primary solvents, and a diluent. The binder is not a critical component as it may be selected from a wide range of heat resistant materials including thermoplastic and thermoset polymers such as polyimides, polyetherimides, amide-imides, polysulfones, polyarylsulfones, polyethersulfones, polycarbonates, epoxies, polyamides, allyls, phenolics, polyesters, fluorocarbons, acetals, alkyds, furans, melamines, polyphenylene sulfides and silicones.

The binders should meet underwriter Lab (U.L.) temperature index criteria for continuous use. The binders should meet the U.L. continuous use temperature index of at least 250° F. (121° C.). Binders meeting this U.L. index criteria exhibit sufficient retention of their mechanical and electrical properties to enable their use in the susceptor coating of the present invention. These same binder materials or their equivalents can be used as a protective film or coating over the exposed susceptor coating to protect food from possible contamination from the susceptor coating.

The fluid carrier can include a dispersant or a dispersant solution formed by a solvent or solvent blend and a wetting agent for the substances being dispersed.

A microwave susceptor coating package, in accordance with the invention, includes a substrate and a susceptor coating on the substrate. The susceptor coating is a combination of semiconductor particles or galvanic couple alloy particles and metallic particles. The weight ratio of metal to semiconductor is in the range from about 1:4 to 65:1. The weight ratio of metal to galvanic couple alloy is in the range from about 2:1 to 1:2. The semiconductor can be carbon black, titanium carbide, silicon carbide and/or zinc oxide. The metal is in particulate form typically flaked or powdered form and is advantageously selected from the class of nickel, zinc, copper or aluminum. A preferred metal/semiconductor combination is particulate aluminum and a semiconductor material selected from carbon black, titanium carbide, silicon carbide or zinc oxide. A conductor/semiconductor combination found to be particularly advantageous is flaked aluminum and carbon black. A preferred ratio by weight of flaked aluminum to carbon black is 32.5:1. A preferred conductor and galvanic couple alloy combination is particulate aluminum and a galvanic couple alloy material selected from aluminum-nickel, aluminum-cobalt or aluminum-copper alloys. A conductor/galvanic couple alloy combination found to be particularly advantageous is flaked aluminum and aluminum-nickel alloy. A preferred ratio by weight of flaked aluminum to aluminum-nickel alloy is 1:1.

The microwave susceptor coating of the invention prevents the occurrence of arcing during use. The susceptor coating reaches a temperature of at least about 350° F. (177° C.) in about 4 minutes when exposed to microwave energy at a conventional household microwave oven power level of about 700 watts. The steps of forming the coating include providing a polymer solution, optionally providing a dispersant or dispersant solution, combining the solutions and dispersing particles into the combined solutions or dispersing the particles in the dispersion solution and combining that mixture with the resin solution.

DESCRIPTION OF THE DRAWINGS

Other aspects of the invention will become apparent after considering an illustrative embodiment taken in conjunction with the drawings in which:

FIG. 1 is a perspective view of a microwavable food package which has been adapted in accordance with the invention;

FIG. 2 is a perspective view of the package of FIG. 1 which is adapted for localized microwave heating;

DETAILED DESCRIPTION

Figure 3:
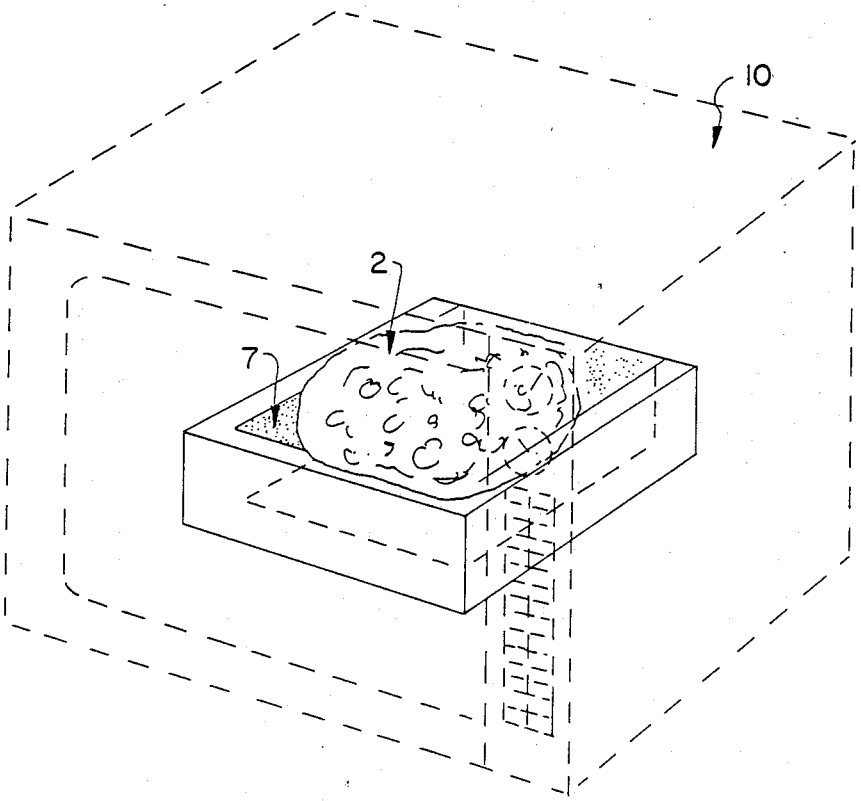
FIG. 3 is a perspective view showing the invention in use in a microwave oven.
Figure 4:
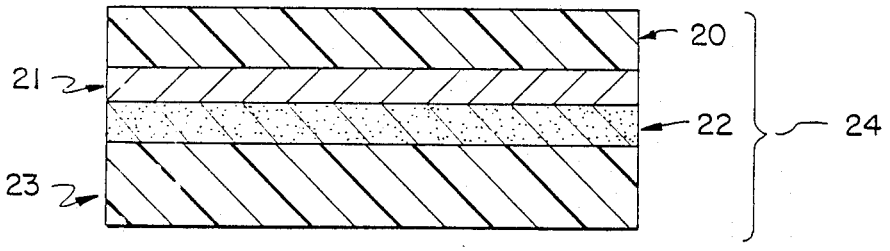
FIG. 4 PRIOR ART
FIG. 4 is a perspective view of the microwave susceptor construction used in the prior art.

With reference to the drawings, a package for microwave cooking is shown in FIG. 1. The package (1) includes a food product (2) within its interior and a removable cover (3) that is removable along a set of incised lines (4). As illustrated in FIG. 1, once the incision is broken, the cover (3) can be elevated to various positions. Three positions are shown in FIG. 1, a preliminary position where the flap panel 8 as been elevated to the outer side wall (5) of the package, a second position shows the flap being removed from the outer edge and the third position shows the flap extended downwardly.

In FIG. 2 the flap panel 8 has been folded over the base (6) exposing a "susceptor" coating (7) which provides localized heating in accordance with the invention. The term "susceptor" is commonly used to designate a coating that provides localized heating by absorbing electromagnetic radiation and converting it to thermal energy.

The package of FIG. 2 is insertable into a microwave oven (FIG. 3) with the food item (2) that is to be crispened placed upon the susceptor coating (7).

The susceptor coating shown in FIGS. 2 and 3 provides microwave crisping and browning without the disadvantages that accompanied the prior art.

The susceptor coating of the invention includes a filler of metallic particles and either semiconductor particles or galvanic couple alloy particles. The susceptor coating is formed by a combination of metallic particles and either semiconductor particles or galvanic couple alloy particles and a polymeric binder. The metallic particles can be in powder, fluff, flake, needle and/or fiber form. The heating strength of the susceptor coating is controlled by the coat weight (mass), geometry and binder properties as well as the filler particle size, choice of filler, filler to binder ratio and the metal to semiconductor or galvanic couple alloy ratio. The ensuing examples are representative of combinations of these parameters which result in good heating control for the susceptor product of the invention. The term semiconductor material as used herein shall have its ordinary technical meaning and also shall include elements or compounds having an electrical conductivity intermediate between that of conductors, e.g., metals and non-conductors (insulators). (See, e.g., G. Hawley, *Condensed Chemical Dictionary,* 11th Edition, VanNostrand Reinhold Company, p. 1033.) The term galvanic couple alloy as used herein shall refer to an alloy formed of a pair of dissimilar metals having different electromotive potential. The two dissimilar metals used in the galvanic couple alloy herein have different electromotive potentials and are charaterized by the ability of one metal to provide an anode and the other to provide a cathode if each metal is employed in a galvanic cell. Galvanic couple metals are futher characterized by corrosion of either the anode or cathode metal (normally the anode metal) when a current passes between them in a galvanic cell. (See e.g., H. H. Uhlig, *Corrosion Handbook,* John Wiley and Sons (1948) p. 481 and J. E. Hatch, *Aluminum: Properties and Physical Metallurgy,* American Society for Metals (1988), p. 257.

In use, the susceptor coating may be applied to a film substrate including but not limited to polyester, polyimide, fluorocarbon, silicone, polyetherimide, nylon, polyethersulfone which is laminated to paperboard or film/sheet. The susceptor coating may also be applied to the package or cooking container, such as a tray. This is used as a cooking surface for the item to be crispened and browned. The cooking surface may be in the form of a packaging panel as in FIG. 1 or a separate panel or tray.

The invention provides a microwave susceptor which is not limited to the tight deposition tolerances that are required for reasonable temperature control in metallized susceptors. In addition, the coating of the laminate can be printed in various thicknesses, shapes and sizes, be thermoformable and transferable from a release surface. The susceptor coating of the invention prevents the occurrence of arcing and allows an object in contact with the coating to be heated to a temperature of at least about 350° F. (177° C.) in about 4 minutes when exposed to microwave energy at a conventional household microwave oven power level of about 700 watts at a frequency of 2450 megahertz.

Conventional metallized susceptor coatings outside of extremely tight metal deposition tolerances do not heat without arcing and can only be used once; carbon black susceptor coatings can burn because of runaway heating.

Variability of heating strength can be controlled by formula modification and pattern. The prior art of metallized aluminum coatings did not provide for variability in heating and may fuse out, (i.e., burn out as in fuse) before the cooking cycle is completed. Various sizes and shapes of susceptor patterns can be printed with the invention. This provides an advantage over the prior art in which sizes and shapes must be controlled by masking before metallizing or etching after metallizing. The invention can be formulated to be reusable and can be printed on permanent cookware or reusable trays. This printability allows the susceptor coating to accommodate various food product sizes and shapes. Also by making possible the printing of different coat weights in different areas, differential heating could be achieved for compartmentalized products like TV dinners, which are comprised of various food courses that require different cooking temperatures.

The susceptor coating of the invention can be printed or coated onto a substrate with patterned or thickness gradient so that any desired regions of the coating can have predetermined thickness. Food in contact with regions of the susceptor having greater coating thickness receives more heating. This enables better heat distribution for large food items, for example, pizzas which require that more heat be directed towards the middle portion of the food. (It is very difficult, if not impractical to achieve such patterned coating distributions using prior art susceptors having aluminum or other vacuum metallized coatings, since deposition amounts in such metallized coating have to be within very tight tolerances to produce a desired heating effect.)

The invention provides a combination of either semiconductors such as carbon, silicon carbide, titanium carbide or zinc oxide; or galvanic couple alloys such as aluminum-nickel, aluminum-cobalt or aluminum copper; and metallic particles such as nickel, copper, zinc or aluminum. The metallic particles are 1 to 34 microns in size. The metal/semi-conductor ratio is on the order of ¼ to 66/1 and the metal/galvanic couple alloy ratio is on the order of 2:1 to 1:2. By using a mixture of metal and semiconductor or galvanic couple alloy, arcing is eliminated. It is believed that 15 nm to 45 micron particles of semiconductor provide a semiconductive bridge which maintains metal particle spacings and avoids arcing without premature shut off. Another result is a reusable susceptor. The galvanic couple alloy particles also inhibit arcing but provide a fusing mechanism. A preferred metal/semiconductor combination is aluminum particles, advantageously in the form of flakes, in combination with carbon black semiconductor. A preferred ratio using flaked aluminum, (e.g., average particle size 25 microns) to carbon black semiconductor (e.g., average particle size 30 nanometers) is 32.5 to 1. The flaked aluminum however may typically range from 6 to 34 microns size. As the amount of carbon is increased, there is an increase in heating ability. Too much carbon limits utility due to burning and is avoided. A preferred metal/galvanic couple alloy combination is aluminum particles in combination with an aluminum-nickel alloy. The aluminum is in the same form stated above and the galvanic couple alloy consists of 31% aluminum and 69% nickel (e.g., average particle size 45 microns). A preferred ratio of aluminum to alloy is 1:1.

The heating response can be controlled by the selection of metal and either semiconductor or galvanic couple alloy. The combination of aluminum particles and carbon black; the combination of aluminum particles and titanium carbide, silicon carbide or zinc oxide; or the combination of aluminum particles to aluminum-nickel, aluminum-cobalt or aluminum-copper alloy particles has been found to improve control over the degree of heating. The choice of binder, coating mass or thickness also affects the amount of heating. As an example, for one formula, a dried coating thickness of 19 microns is needed to achieve 260° C. (500° F.) and a thickness of 13 microns is needed to achieve 165° C. (329° F.) by the test method in Example 9, below. A desirable range of thickness for the dried susceptor coating is between about 6 micron to 250 micron. The dried coating thickness within this range can be selected to facilitate temperature of the susceptor during exposure to microwave. Heat resistant thermoplastic resins are desired for the binder to keep the pigments from overheating. It is theorized that as the resin glass transition temperature, ($T_g$) is reached, the binder expands so that at some point the metal particle contact with each other will be lost thereby preventing further heating until the binder cools down and contracts making the filler particles in contiguous contact again. For polyethersulfone resin ($T_g$=229° C.) in combination with aluminum particles and carbon the temperature plateau is 266° C. as compared with 182° C. for polyamide ($T_g$=101° C.) in combination with the same aluminum particles and carbon. For low pigment loadings thermoset polymers are acceptable.

Heating response can also be controlled by the ratio of binder to total filler metal and either semiconductor material or galvanic couple alloy. The greater the amount of binder relative to metal and either semiconductor or galvanic couple alloy the lower the temperature of the susceptor coating will be when exposed to microwave radiation. Adding binder also increases the coatings film integrity. Binders can be solvent based, water based or 100% polymeric solids and include resinous types and elastomeric types.

Another way of controlling the heating properties of susceptor coatings is to use different metals and semiconductors or galvanic couple alloys, alone or in combination. Variations in metal particle properties such as electrical and thermal conductivity, density and geometry also affect the amount of heat produced by the susceptor coating.

The ingredients used in the subject of this invention are sufficiently low in cost to be disposable after a single use, but the susceptor formulated from metals and semiconductors is sufficiently durable to permit reuse.

Additionally, the susceptor coating of the present invention may be printed onto a temporary carrier with or without a separate release layer but more typically with a separate release layer. An adhesive layer may be coated over the susceptor layer. The susceptor coating with adhesive layer then can form a heat transferable layer as in U.S. Pat. No. 3,616,015 herein incorporated by reference. The transferable layer can then be transferred from the temporary carrier onto a food packaging component or container thus forming a susceptor coated panel. The transferable layer can be heat transferred for example, under conventional heat transfer temperatures and pressures and process employed in heat transferring laminates from a temporary carrier to an article as described in U.S. Pat. No. 3,616,015.

In Example 1, having the formulation shown in Table I a microwave susceptor coating was formulated beginning with a resin solution and a primary dispersant solution. Lecithin was used as a secondary dispersant. To control viscosity, dimethylformamide, and methyl ethyl ketone, were added to the resin and dispersant solutions. The resin employed was polyethersulfone. The dispersant solution was comprised of a solvated polyester/polyamide copolymer. The polyester/polyamide copolymer employed is available from the ICI America, Inc. under the trademark SOLSPERSE hyperdispersant 24000.

To this were added 6 to 9 microns size aluminum particles and carbon black on a metal to semiconductor ratio of 13:1. The preferred carbon black is of the electroconductive type having a hollow shell-like particle shape to give high surface area. The total filler (aluminum and carbon black) to resin ratio by weight was 3.4:1. This mixture was ball milled until a homogeneous dispersion was achieved. This dispersion was coated onto a polyimide substrate and dried in a convection oven to evaporate the solvents resulting in a 19 micron thick susceptor coating on the substrate. When a ceramic plate was placed in contact with the susceptor and exposed to radiation in a conventional 700 watt output microwave oven, the susceptor heated the plate to a temperature of about 254° C. in about 2 minutes.

A second coating example was formulated in the same manner as the first but the amounts of aluminum and carbon black were changed to give an aluminum to carbon black ratio of 8:1. Coatings of 19 microns or 13 microns thickness would burn when exposed to microwaves but a 6 microns thick coating would heat a contiguous ceramic plate in contact therewith to 247° C. in about 2 minutes.

In a third example, the aluminum to carbon black ratio was the same as in example 1, but the total filler (aluminum and carbon) to binder ratio was 1:1. A 19 microns thick coating heated the ceramic plate to 241° C. in about 2 minutes.

For Example 4, the polyethersulfone and the primary solvent of Example 3 were replaced with vinyl chloride-vinyl acetate copolymer and an appropriate primary solvent, such as toluene, respectively. A ceramic plate was heated by a 19 microns thick coating to 177° C. in about 2 minutes.

In Example 5 the vinyl resin and solvent of Example 4 were replaced by polyamide and an alcohol, respectively. The heating test yielded a result of 154° C. in about 2 minutes for a 19 microns thick coating.

For Example 6 a coating similar to that in Example 3 was made but the aluminum was replaced by copper (1–5 microns). A 19 micron thick coating heated the ceramic plate to a temperature of about 172° C. in about 2 minutes when placed in a 700 watt microwave oven.

Example 7 was the same as Example 6 but the copper was replaced by nickel (1–5 microns). The ceramic plate was heated to a temperature of about 266° C. in about 2 minutes when placed in a 700 watt microwave oven.

In Example 8, the resin and solvents of Example 7 were replaced by a liquid two part epoxy system. The ratio of diglycidal ether of bisphenol A (epoxy) to polyamide hardener is 100:33–125. Similar results were achieved.

In Example 9 (Table II) the same components for the resin solution as shown in Example I (Table I) plus n-methyl pyrrolidone solvent were employed and the dispersant lecithin was used. However, the primary dispersant solution was eliminated, the metal was changed from aluminum powder to aluminum flake paste. The aluminum flake paste was composed of aluminum flakes having an average particle size of about 25 microns. The aluminum flakes were of the nonleafing grade. The aluminum flakes were predispersed in mineral spirits to form a paste in a weight ratio of about 65 wt. % aluminum to 35 wt. % mineral spirits. The complete formulation for this Example 9 is set forth in Table II.

Aluminum flakes are characterized by their high aspect ratio of length to width as would be expected of a flake particle. This is in contrast to aluminum particles used in Example 1 which tend to be more granular in shape. The same semiconductor material as used in Example 1 was employed, namely electroconductive carbon black at an average particle size of 30 nanometers and average surface area of 800 sq. meters per gram. The coating mixture having the composition shown in Table II was prepared by first mixing the resin solution heated to a temperature of about 150° F. (66° C.) to hasten solvation. Then the lecithin and carbon black were added. The mixture thereupon was ball milled using steel ball grinding media. The aluminum flakes were then added to the mixture and the mixture was stirred to achieve a homogeneous dispersion. The coating was applied to a polyimide film using a #42 Meyer rod. The coating was then dried to evaporate the solvent, thus producing the susceptor product.

The susceptor of Example 9 was then tested. A 3½" diameter circle was cut out from the polyimide film coated with susceptor coating. This circle was placed upon an inverted Corningware "Visions" skillet then covered by a Corningware ceramic "Corelle" flat plate. The susceptor was thus elevated about 1.75 inches from the oven floor. This arrangement was placed in a conventional household 700 W output microwave oven and radiated with microwave radiation for consecutive 2 minute intervals at full power. (The microwave oven operated at the conventional household microwave frequency of 2450 MHZ. Similarly, all the examples herein were done at the same conventional household microwave oven power output of 700 watts and at a frequency of 2450 megahertz. At the end of each interval the plate was removed from the oven and the plate surface that was in contact with the susceptor was measured over several spots with a thermocouple thermometer. (Measurements took about 20 to 30 seconds.) The temperature was recorded, the plate was replaced over the susceptor and the next 2 minute interval was started. At least 10 intervals were tested and measured. The results of this test are shown in Table i below.

TABLE i

| Example 9 | | |
|---|---|---|
| Interval | Avg. Temp. | |
| (2 min. per interval) | °F. | °C. |
| 1 | 361 | 183 |
| 2 | 490 | 254 |
| 3 | 526 | 274 |
| 4 | 520 | 271 |
| 5 | 513 | 267 |
| 6 | 509 | 265 |
| 7 | 509 | 265 |
| 8 | 487 | 253 |
| 9 | 492 | 256 |
| 10 | 476 | 247 |

This data demonstrates that nonmetallic objects placed in contact with the susceptor can be heated quickly, i.e., within 4 minutes to high temperature of about 490° F. (254° C.). Such temperature levels are more than adequate to brown and crisp baked goods. The data also reveals that the temperature level of the ceramic plate heated reached a temperature of about 490° F. (254° C.) in 4 minutes and a plateau, i.e., a maximum temperature level of about 500° F. (260° C. to 540° F. (282° C.) The same experiment was done without any susceptor coating on the polyimide substrate. Within 4 minutes the temperature of the ceramic plate only reached 250° F. (121° C.) which is much too low a temperature to achieve browning and crisping. The use of the carbon black semiconductor material in combination with the aluminum flake achieves a more rapid rate of heating than would be the case if aluminum flake without a semiconductor material is employed. Also the heating was found to be more manageable than if a coating containing only carbon black material was used, since coatings containing only carbon black tend to heat more rapidly and reach higher maximum temperatures which can be hazardous.

The same susceptor used in this example was then reused in the same manner with a similar temperature/-time profile as shown in Example 9.

In Example 10 the metal employed was aluminum flake paste as in Example 9, however the semiconductor material was titanium carbide. The titanium carbide was 99.9% pure having a 325 mesh size (about 45 micron particle size). The resin solution contained the same components as in Example 1 with addition of n-methylpyrrolidone solvent as depicted in Table III. The preparation of this formulation was made in the same manner as described in Example 9, except that titanium carbide was used in place of carbon black. The mixture was coated onto polyimide substrate. The polyimide high temperature resistant film substrate is available under the trademark KAPTON from E. I. DuPont Company. The coating was then dried in conventional convection ovens to evaporate the solvents and thus produce the energy converting susceptor product.

The susceptor of Example 10 was tested in the same manner as the susceptor in Example 9. The results of this test are shown in Table ii.

TABLE ii

| Example 10 | | |
|---|---|---|
| Interval | Avg. Temp. | |
| (2 min per interval) | °F. | °C. |
| 1 | 285 | 141 |
| 2 | 406 | 208 |
| 3 | 452 | 233 |
| 4 | 471 | 244 |
| 5 | 461 | 238 |
| 6 | 473 | 245 |
| 7 | 440 | 227 |
| 8 | 458 | 237 |
| 9 | 458 | 237 |
| 10 | 459 | 237 |

The data revealed a heating of the ceramic plate to a temperature of about 406° F. (208° C.) within 4 minutes and a maximum temperature plateau of about 460° F. (238° C.) to 470° F. (245° C.).

In Example 11, the same components as in Example 10 were employed except that the semiconductor material was zinc oxide instead of titanium carbide. The formulation for the susceptor coating of Example 11 is shown in Table IV. The coating was prepared and dried on a polyimide substrate (heat resistant film available under the trademark KAPTON from E. I. DuPont Company) in the same manner as described in the preceding example to produce a microwave energy converting product.

The susceptor of Example 11 was tested in the same manner as the susceptor in Example 9. The results of this test are shown below in Table iii.

TABLE iii

| Example 11 | | |
|---|---|---|
| Interval | Avg. Temp. | |
| (2 min. per interval) | °F. | °C. |
| 1 | 332 | 167 |
| 2 | 387 | 197 |
| 3 | 463 | 239 |
| 4 | 471 | 244 |
| 5 | 454 | 234 |
| 6 | 465 | 241 |
| 7 | 474 | 246 |
| 8 | 445 | 229 |
| 9 | 414 | 212 |
| 10 | 439 | 226 |

The data revealed a heating of the ceramic plate to a temperature of about 390° F. (199° C.) in about 4 minutes and a maximum temperature plateau of about 450° F. (232° C.) to 475° F. (246° C.).

In Example 12, the same components as in Example 11 were employed except that the semiconductor material was silicon carbide instead of zinc oxide. The formulation for the susceptor coating of Example 12 is shown in Table V. The coating was prepared and dried on Kapton film substrate in the same manner as described in Example 10 to produce a microwave energy converting product.

The susceptor of Example 12 was tested in the same manner as the susceptor in Example 9. The results of this test are shown below in Table iv.

TABLE iv

| Example 12 | | |
|---|---|---|
| Interval | Avg. Temp. | |
| (2 min. per interval) | °F. | °C. |
| 1 | 247 | 119 |
| 2 | 358 | 181 |
| 3 | 414 | 212 |
| 4 | 518 | 270 |
| 5 | 500 | 260 |
| 6 | 518 | 270 |
| 7 | 529 | 276 |
| 8 | 547 | 286 |
| 9 | 548 | 287 |
| 10 | 554 | 290 |

The data revealed a heating of the ceramic plate to about 360° F. (182° C.) in about 4 minutes and a maximum temperature plateau of about 500° F. (260° C.) to 550° F. (288° C.).

In Example 13, to demonstrate hazardous thermal runaway, a susceptor coating was made in which carbon black was the only filler. In this example, the same components used in Example 9 were used except that the aluminum was omitted and no other metal was used in its place. The formulation for the susceptor coating of Example 13 is shown in Table V. The per cent filler loading of Example 13 was much lower than for any of the previous examples because carbon black acts as a thixotrope. Even at the low level used in Example 13, the mixture was barely pourable. Despite the low filler loading, however, it can be seen in Table iv that high temperatures are achieved very quickly and that the dangers of thermal runaway become evident, e.g., smoke and fire. The preparation of this formulation was made in the same manner as described in Example 9. The mixture was coated onto DuPont's KAPTON polyimide film. The coating was then dried in conventional convection ovens to evaporate the solvents and thus produce the energy converting susceptor product.

The susceptor of Example 13 was tested in the same manner as the susceptor in Example 9. The results of this test are shown in Table iv.

TABLE v

| Example 13 | | |
|---|---|---|
| Interval | Avg. Temp. | |
| (2 min. intervals) | °F. | °C. |
| 1 | 527[a] | 275 |
| 2 | 548[b] | 287 |
| 3 | 613[c] | 373 |

TABLE v-continued

| Example 13 | | |
|---|---|---|
| Interval (2 min. intervals) | Avg. Temp. °F. | °C. |
| aborted because of burning | | |

Notes:
[a]small holes melting in Kapton
[b]slight burning smell detected; very slight smoke
[c]susceptor caught on fire during the last 15 seconds of the cycle.

The data revealed a heating of the ceramic plate to a temperature of about 548° F. (287° C.) within 4 minutes. However, the observation cited in the Table v notes indicate that combustion is inevitable if the test is carried out further. If a flammable, conventional substrate such as paperboard were used, the problem would be compounded.

The results depicted in Tables i to iv indicate that the combination of metal and semiconductor in a susceptor coating provides control over thermal runaway. This is evidenced by the fact as supported by the data in Tables i to iv that the susceptor compositions of the present invention result in high level heating but yet reach a low enough plateau temperature within a typical microwave heating interval of about 8 minutes in conventional household microwave oven at 700 watts to give the user better control over the heating process. The level heating obtained in the susceptor used in Examples 1 to 12 is sufficient to result in browning and crisping of dough based or breaded foods, e.g., breads, pizzas and breaded or battered fish.

Example 14 depicts a susceptor that gives even more control over thermal runaway by means of an actual shut-off or fusing. In this example the same polyethersulfone resin and aluminum flake filler used in prior examples was used but an aluminum-nickel galvanic couple alloy was used in place of a semiconductor. No dispersant solution was used although it could have been. All particles were mechanically mixed but not milled as described in Example 9. The formulation for this susceptor coating is presented in Table vii. The coating was prepared and dried on Kapton film substrate in the same manner as described in Example 10 to produce a microwave energy converting product.

The susceptor of Example 14 was tested similarly to the susceptor of Example 9 with the following exception: Instead of heating it for 10 consecutive cycles, only 5 cycles were performed before the susceptor was removed. The susceptor was then placed between a second set of "Visions" skillet and "Corelle" ceramic plate that had been maintained at room temperature. The 5 heating cycles were then repeated. For comparison a susceptor from Example 9 was also tested in this manner. As a benchmark an uncoated Kapton film substrate was heated for 5 cycles. The results of this test are shown in Table vi.

TABLE vi

| Example 14 | | | | |
|---|---|---|---|---|
| Interval (2 min. intervals) | Avg. Temp. Example 14 °F. | Example 14 °C. | Example 9 °F. | Example 9 °C. |
| 1 | 287 | 142 | 388 | 198 |
| 2 | 400 | 204 | 451 | 233 |
| 3 | 430 | 221 | 537 | 281 |
| 4 | 487 | 253 | 583 | 306 |
| 5 | 471 | 244 | 608 | 320 |

Kapton

TABLE vi-continued

| Example 14 | | | | | | |
|---|---|---|---|---|---|---|
| | Reuse | | Reuse | | Initial | |
| | °F. | °C. | °F. | °C. | °F. | °C. |
| 1 | 181 | 83 | 310 | 154 | 178 | 81 |
| 2 | 270 | 132 | 448 | 231 | 261 | 127 |
| 3 | 335 | 168 | 512 | 267 | 331 | 166 |
| 4 | 384 | 196 | 556 | 271 | 368 | 187 |
| 5 | 433 | 223 | 605 | 318 | 398 | 203 |

The data reveals the susceptor of Example 14 to be microwave interactive as is the susceptor of Example 9 the first time it is used but unlike the susceptor of Example 9 it becomes microwave inert and is comparable to an uncoated Kapton film substrate.

In Example 15 the same components as those used in Example 14 are used plus an oxidizing salt. Potassium bisulfate was milled into an aliquot of the resin solution used in Example 14 and this dispersion was added to the other components. The formulation for the susceptor coating of Example 15 is shown in Table viii. The coating was prepared and dried on Kapton film substrate and tested in the same manner as the susceptor in Example 14. The results of this test are shown in Table vii.

TABLE vii

| Example 15 | | |
|---|---|---|
| Interval (2 min. intervals) | Avg. Temp. °F. | °C. |
| 1 | 263 | 128 |
| 2 | 386 | 197 |
| 3 | 383 | 195 |
| 4 | 416 | 213 |
| 5 | 436 | 224 |
| Reuse | | |
| 1 | 194 | 90 |
| 2 | 289 | 143 |
| 3 | 352 | 178 |
| 4 | 398 | 203 |
| 5 | 419 | 215 |

The data indicates that the oxidizing salt causes the susceptor to oxidize more rapidly and reach a lower plateau. As in Example 14 the susceptor becomes microwave inert.

For Example 16 the same components of the susceptor used in Example 14 were used except an aluminum-cobalt alloy was used in place of the aluminum-nickel alloy. The formulation for the Example 16 susceptor is shown in Table ix. The coating was applied to and dried on Kapton film substrate and tested in the same manner as the susceptor in Example 14. The results of this test are shown in Table viii.

TABLE viii

| Example 16 | | |
|---|---|---|
| Interval (2 min. intervals) | Avg. Temp. °F. | °C. |
| 1 | 273 | 134 |
| 2 | 376 | 191 |
| 3 | 455 | 235 |
| 4 | 498 | 259 |
| 5 | 491 | 255 |
| Reuse | | |
| 1 | 184 | 84 |
| 2 | 278 | 137 |
| 3 | 335 | 168 |
| 4 | 381 | 194 |
| 5 | 412 | 211 |

The data reveals essentially the same heating profile exhibited in Table vi; the susceptor is initially microwave interactive but then oxidized to become microwave inert.

TABLE I

| Example 1 | |
|---|---|
| Susceptor Coating Formulation | Wt. % |
| Resin Solution | |
| Polyethersulfone Resin (e.g., general purpose grade VICTREX 4100P) | 9.1 |
| Dimethylformamide (Solvent) | 18.1 |
| Methylethylketone (diluent) | 18.1 |
| Primary Dispersant Solution | |
| Polyester/polyamide copolymer (e.g., Solsperse hyperdispersant 24000 from ICI America, Inc.) | 1.0 |
| Dimethylformamide | 1.9 |
| Methyl ethyl ketone | 1.9 |
| Secondary Dispersant | |
| Lecithin (soy phospholipids) | 0.2 |
| Metal and Semiconductor Filler | |
| Aluminum Powder: (6 to 9 micron particle size, avg. surface area of 0.8 to 1.1 sq. meters per gm) | 28.3 |
| Carbon Black: (Electroconductive carbon black of avg. particle size 30 nanometers and avg. surface area 800 sq. meters per gm) | 2.2 |
| Diluting Solvents | |
| Dimethylformamide | 9.6 |
| Methyl ethyl ketone | 9.6 |
| | 100.0 |

TABLE II

| Example 9 | |
|---|---|
| Susceptor Coating Formulation | Wt. % |
| Resin Solution | |
| Polyethersulfone resin | 12.3 |
| Dimethylformamide (solvent) | 24.5 |
| N-Methyl pyrrolidone (solvent) | 10.9 |
| Methyl ethyl ketone (diluent) | 24.5 |
| Dispersant | |
| Lecithin (soy phospholipids) | 0.1 |
| Metal and Semiconductor Filler | |
| Aluminum flake paste 25 micron particle size aluminum flakes in paste of 65% by weight aluminum and of 35% by weight mineral spirits) | 27.2 |
| Carbon Black (avg. particle size 30 nanometers, 800 sq. meters per gram) | 0.5 |
| | 100.0 |

TABLE III

| Example 10 | |
|---|---|
| Susceptor Coating Formulation | Wt. % |
| Resin Solution | |
| Polyethersulfone resin | 10.9 |
| Dimethylformamide (solvent) | 21.8 |
| N-Methyl pyrrolidone (solvent) | 9.8 |
| Methyl ethyl ketone (diluent) | 21.8 |
| Dispersant Solution | |
| Solsperse 24000 polyester/polyamide dispersant | 0.1 |
| Dimethylformamide (solvent) | 0.2 |
| Methyl ethyl ketone (solvent) | 0.2 |
| Titanium Carbide Filler | |
| 99.9% pure particles (45 micron particle size) | 5.8 |

TABLE III-continued

| Example 10 | |
|---|---|
| Susceptor Coating Formulation | Wt. % |
| Aluminum Flake Paste Filler | |
| 25 micron particle size aluminum flakes in paste of 65% by weight aluminum flakes and 35% by weight mineral spirits | 29.4 |
| | 100.0 |

TABLE IV

| Example 11 | |
|---|---|
| Susceptor Coating Formulation | Wt. % |
| Resin Solution | |
| Polyethersulfone resin | 5.7 |
| Dimethylformamide (solvent) | 28.9 |
| N-Methyl pyrrolidone (solvent) | 5.1 |
| Methyl ethyl ketone (diluent) | 11.3 |
| Dispersant Solution | |
| Solsperse 24000 polyester/polyamide copolymer dispersant | 0.5 |
| Dimethyl formamide (solvent) | 1.0 |
| Methyl ethyl ketone (solvent) | 1.0 |
| Zinc oxide Filler | |
| 0.21 micron avg. particle size 5.0 sq. meters per gm. surface area | 22.9 |
| Aluminum Flake Paste Filler | |
| 25 micron particle size aluminum flakes in a paste of 65% by weight aluminum and 35% by weight mineral spirits | 23.5 |
| | 100.0 |

TABLE V

| Example 12 | |
|---|---|
| Susceptor Coating Formulation | Wt. % |
| Resin Solution | |
| Polyethersulfone resin | 7.7 |
| Dimethylformamide (solvent) | 27.4 |
| N-Methylpyrrolidone (solvent) | 6.8 |
| Methyl ethyl ketone (diluent) | 15.4 |
| Dispersant Solution | |
| Solsperse 24,000 polyester/polyamide | 0.2 |
| Dimethylformamide (solvent) | 0.4 |
| Methyl ethyl ketone (solvent) | 0.4 |
| Silicon Carbide Filler | |
| 1 micron particle size | 10.2 |
| Aluminum Flake Paste Filler | |
| 25 micron particle size Aluminum flakes in a paste of 65% by weight aluminum and 35% by weight mineral spirits | 31.5 |
| | 100.0% |

TABLE VI

| Example 13 | |
|---|---|
| Susceptor Coating Formulation | Wt. % |
| Resin Solution | |
| Polyethersulfone resin | 11.1 |
| Dimethylformamide (solvent) | 41.0 |
| N-Methylpyrrolidone (solvent) | 9.7 |
| Methyl ethyl ketone (diluent) | 34.0 |
| Dispersant | |
| Lecithin (soy phospholipids) | 0.2 |
| Semiconductor Filler | |
| Carbon black (avg. particle size 30 nanometers, 800 sq. meters per gram) | 4.0 |

TABLE VI-continued

| Example 13 | |
|---|---|
| Susceptor Coating Formulation | Wt. % |
| | 100.0 |

TABLE VII

| Example 14 | |
|---|---|
| Susceptor Coating Formulation | Wt. % |
| Resin Solution | |
| Polyethersulfone resin | 11.3 |
| Dimethylformamide (solvent) | 22.5 |
| N-Methyl pyrrolidone (solvent) | 10.0 |
| Methyl ethyl ketone (diluent) | 22.5 |
| Aluminum Flake Paste Filler | |
| 25 micron particle size aluminum flakes in a paste of 65% by weight aluminum and 35% by weight mineral spirits | 20.4 |
| Aluminum-Nickel Alloy Filler | |
| 45 micron particle size 31% by weight aluminum and 69% by weight nickel | 13.3 |
| | 100.0% |

TABLE VIII

| Example 15 | |
|---|---|
| Susceptor Coating Formulation | Wt. % |
| Resin Solution | |
| Polyethersulfone resin | 9.9 |
| Dimethyl formamide (solvent) | 19.8 |
| N-Methyl pyrrolidone (solvent) | 8.8 |
| Methyl ethyl ketone (diluent) | 19.8 |
| Aluminum Flake Paste Filler | |
| 25 micron particle size aluminum flakes in a paste of 65% by weight aluminum and 35% by weight mineral spirits | 17.9 |
| Aluminum-Nickel Alloy Filler | |
| 45 micron particle size 31% by weight aluminum and 69% by weight nickel | 11.7 |
| Milled Salt Dispersion | |
| Potassium bisulfate | 2.0 |
| Polyether sulfone resin | 1.7 |
| Dimethylformamide (solvent) | 3.4 |
| N-Methyl pyrrolidone (solvent) | 1.6 |
| Methyl ethyl ketone (diluent) | 3.4 |
| | 100.0% |

TABLE IX

| Example 16 | |
|---|---|
| Susceptor Coating Formulation | Wt. % |
| Resin Solution | |
| Polyethersulfone resin | 11.3 |
| Dimethylformamide (solvent) | 22.5 |
| N-Methyl pyrrolidone (solvent) | 10.0 |
| Methyl ethyl ketone (diluent) | 22.5 |
| Aluminum Flake Paste Filler | |
| 25 micron particle size aluminum flakes in a paste of 65% by weight aluminum and 35% by weight mineral spirits | 20.4 |
| Aluminum-Cobalt Alloy Filler | |
| 150 micron particle size 69% by weight aluminum and 31% by weight cobalt | 13.3 |
| | 100.0% |

Although the invention has been described within the context of particular examples and embodiments for the susceptor coating formulation, the invention is not intended to be limited to the preferred formulations described herein. Although a preferred heat resistant resin has been used in the preferred formulation, the particular polymeric binder or classes of binders disclosed herein are not believed to be critical to the invention inasmuch as one skilled in the art would be able to choose suitable resins having the property requirements disclosed herein. Similarly, other solvents, diluents or water/surfactant combinations could be employed to disperse the solid particles other than the preferred diluents and solvents disclosed herein.

Accordingly, the invention is not intended to be limited by the description in the specification, but rather the invention is defined by the claims and equivalents thereof.

We claim:

1. A microwave susceptor coating panel which comprises a heat resistant substrate and a susceptor coating on said substrate;

said susceptor coating comprising a combination of metallic particles and galvanic couple alloy particles, and a heat resistant polymeric binder wherein said coating converts microwave radiation to heat sufficient to cause heating to a temperature of at least 350° F. (177° C.) within about 4 minutes at a conventional microwave power output level of 700 watts at a frequency of 2450 Megahertz.

2. A susceptor panel as defined in claim 1 wherein the metal particles comprise aluminum in flaked, powdered, fiber, needle, or fluff form.

3. A susceptor panel as defined in claim 2 wherein the average particle size of the aluminum is between 6 to 34 microns.

4. A susceptor panel as in claim 1 wherein the galvanic couple alloy particles comprises aluminum-nickel alloy and the metallic particles comprises aluminum.

5. A susceptor panel as defined in claim 4 wherein the susceptor coating further comprises potassium bisulfate.

6. A susceptor panel as defined in claim 1 wherein the weight ratio of metallic particles to galvanic couple alloy particles is in a range between about 2:1 to 1:2.

7. A susceptor panel as defined in claim 1 wherein the metal particles comprise aluminum and the galvanic couple alloy particles are selected from the group consisting of aluminum-cobalt alloy and aluminum-copper alloy.

8. A susceptor panel as defined in claims 1 or 7 wherein the galvanic couple alloy average particle size is in a range between about 1 to 150 microns.

9. A susceptor panel as defined in claim 1 wherein said panel is limited to one use after which it becomes microwave inert and wherein said panel can be formed to shaped or contoured configuration.

10. A susceptor panel as defined in claim 1 wherein the thickness of said susceptor coating is in a range between about 6 microns to 250 microns.

11. A susceptor panel as defined in claim 1 wherein the susceptor coating is applied to a temporary carrier and said susceptor coating is transferable to a surface by a heat resistant adhesive layer applied over the susceptor coating.

12. A susceptor coating panel as defined in claim 1 wherein said binder is selected from the class consisting of polyimides, polysulfones, polyarylsulfones, polyetherimides, amide-imides, polyethersulfones, polyamides, polycarbonates, epoxies, allyls, phenolics, polyesters, fluorocarbons, acetals, alkyds, furan, melamines, polyphenylenes, polyphenylen sulfides and silicones.

13. A microwave susceptor coating panel as defined in claim 1 wherein the thickness, area covered and pattern of the susceptor coating is selected to control the heat up rate and amount of heat converted from electromagnetic energy.

* * * * *